252-99 AU 166 EX
5/5/81 XR 4,265,776 C

United States Patent [19]
Gohla et al.

[11] 4,265,776
[45] May 5, 1981

[54] DETERGENT AND CLEANING COMPOSITIONS

[75] Inventors: Werner Gohla, Niederkassel; Klaus Hestermann; Joachim Kandler, both of Erftstadt; Horst-Dieter Wasel-Nielen, Hürth; Klaus Sommer; Hans-Adolf Rohlfs, both of Heidelberg; Karl Merkenich, Rimbach, all of Fed. Rep. of Germany

[73] Assignee: Hoechst Aktiengesellschaft, Fed. Rep. of Germany

[21] Appl. No.: 130,156

[22] Filed: Mar. 13, 1980

Related U.S. Application Data

[63] Continuation of Ser. No. 968,295, Dec. 11, 1978, abandoned.

[30] Foreign Application Priority Data

Dec. 19, 1977 [DE] Fed. Rep. of Germany ..... 2756516

[51] Int. Cl.[3] ..... C11D 3/30; C11D 7/56; C11D 9/42

[52] U.S. Cl. ..... 252/98; 252/97; 252/99; 252/110; 252/174.16; 252/526; 252/539; 252/DIG. 11

[58] Field of Search ..... 252/97, 98, 99, 110, 252/174.16, 526, 539, DIG. 11, DIG. 17, 180, 181

[56] References Cited

U.S. PATENT DOCUMENTS

| | | | |
|---|---|---|---|
| B 373,051 | 1/1975 | Kowalski | 204/44 |
| 3,297,578 | 1/1967 | Crutchfield et al. | 252/99 |
| 3,368,978 | 2/1968 | Irani | 252/526 |
| 3,383,323 | 5/1968 | Irani | 252/526 |
| 3,451,939 | 6/1969 | Ralston | 252/181 |
| 3,526,592 | 9/1970 | Quimby | 252/174.16 |
| 3,586,633 | 6/1971 | Schlussler | 252/526 |
| 3,925,228 | 12/1975 | Cheng | 252/110 |
| 4,029,696 | 6/1977 | Sommer et al. | 260/502.5 |

FOREIGN PATENT DOCUMENTS 2318416 11/1974 Fed. Rep. of Germany .

*Primary Examiner*—P. E. Willis, Jr.
*Attorney, Agent, or Firm*—Connolly and Hutz

[57] ABSTRACT

The invention provides cleaning and detergent compositions which contain about 0.2 to 5 weight % of at least one compound of the general formula (I)

in which R stands for a hydrogen atom or a methyl group and $R_1$ stands for a hydrogen atom or an alkali metal or $NH_4$-ion.

1 Claim, 2 Drawing Figures

DETERGENT AND CLEANING COMPOSITIONS

Figure 1:
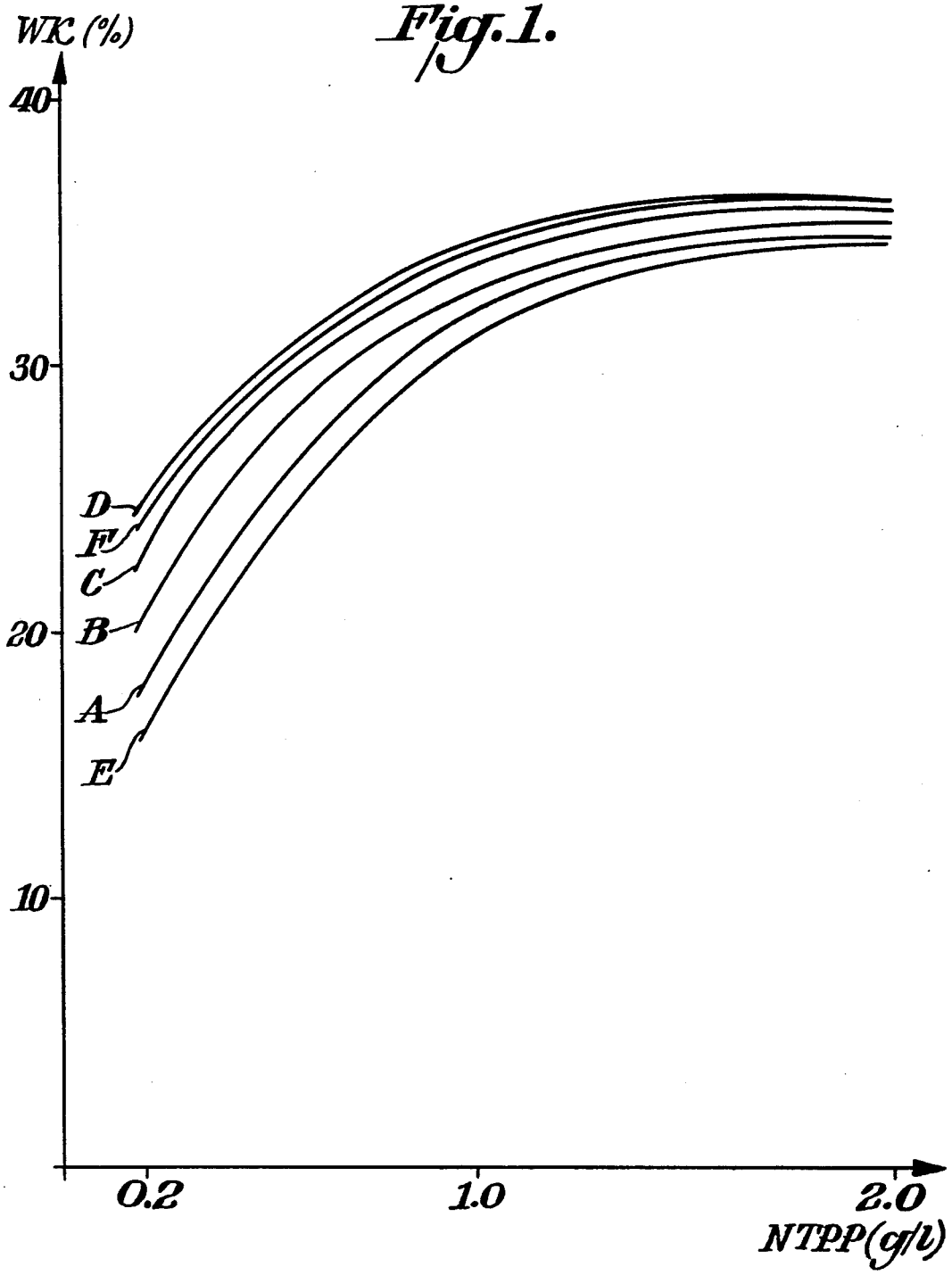

This application is a continuation of application Ser. No. 968,295 filed Dec. 11, 1978, now abandoned.

The present invention provides detergent and cleaning compositions containing a compound of low phosphorus content as a builder together with customary surfactants, builders and auxiliary agents.

It has already been disclosed that the cleaning power of soaps and synthetic surfactants can be improved by means of certain addends, which are termed builders.

The mechanism and the details of the builder effect have not yet been fully described so that it is substantially impossible to predict whether a particular compound is qualified for use as a builder.

In view of the many factors which all contribute to improving the cleaning power of surfactants, and in view of the most recent art in this field, it is necessary for a builder to meet the following requirements, namely:

(1) to sequester the hardness-inducing agents of the water, such as calcium and magnesium ions;

(2) to disperse pigment dirt particles, which are the principal constituents of the dirt of fabrics, in the wash-bath;

(3) to stabilize the dirt removed in the wash-bath and prevent dirt particles from redepositing on the fiber;

(4) to inactivate mineral matter being contained in the wash-bath; and (5) to reduce the adsorption of surfactant on the fiber.

To determine the quality and qualification of individual materials for use as a builder, it is good practice to test their behaviour and efficiency in washing or cleaning operations, to ensure the qualitative and quantitative determination of all factors that make their contribution to the builder effect.

Classical builders comprise water-soluble alkali metal salts of inorganic acids, such as alkali metal carbonates, borates, phosphates, polyphosphates, bicarbonates and silicates.

While a plurality of builders have been suggested for use as builders, the fact remains that alkali metal polyphosphates are generally preferred as they meet all of the requirements set forth hereinabove and synergetically improve the cleaning efficiency, in combination with surfactants. This is the reason why they are used today as the principal constituent in detergents for heavy, fine and coloured fabrics. More particularly, pentasodium triphosphate is used. Detergents generally contain from 25–65%, and cleaning agents partially contain up to 90 weight% of said builder.

The considerably increased consumption of phosphate-containing detergent and cleaning agents both for domestic and industrial purposes has also effected and increase in the phosphate content of natural water. In studies of the eutrophication of waters, which has been found to occur at increasing rates, the water-soluble nitrate and phosphate salts have recently been held to have properties that are able under certain conditions to promote the growth of certain alga species, thereby to make their contribution to the eutrophication of water, and also to affect the oxygen demand of these waters considerably. Even though it is impossible for the time being definitely to clarify this problem, namely the contribution of phosphate-containing detergents and cleaning compositions to the eutrophication of water, it is highly desirable to have potential substitutes free from nitrogen and phosphorus for the builders that find wide-spread use in current detergent formulations, or to reduce the total phosphorus concentration in detergent formulations, by the use of alkali metal polyphosphates in combination with further suitable detergent components.

Various organic compounds have already been suggested for use as builders, e.g. nitrilotriacetic acid, ethylenediaminetetracetic acid, citric acid, oxydiacetic acid, oxydisuccinic acid, cyclocarboxylic acids or polymeric carboxylic acids, such as polymers with unsaturated carboxylic acids, olefins or short chain unsaturated aliphatic ethers or alcohols.

These substances are, however, not fully satisfactory in respect of the following: They either have an extremely high power for complexing heavy metals and transition metals, whereby it is made possible for the heavy metals by the direct sequestration, or later during the remobilization, of the water sediment, to concentrate in surface water and thereby to find their way into drinking water, or they have unsatisfactory builder properties and accordingly produce unsatisfactory wash results. In addition to this, the art is partially in need of processes which would permit these compounds to be made under commercially attractive conditions.

In German Patent Specifications "Offenlegungsschriften" Nos. 2 141 983 and 2 180 101 it has been suggested that oligocarboxyalkanephosphonic acids, which contain considerably less phosphorus than pentasodium triphosphate, should be used as builders. While these builders actually have a considerable complexing power for hardness-inducing agents contained in water, are useful incrustation inhibitors in detergent and cleaning compositions, and can successfully be employed for the cleaning of metal or glass articles, the fact remains that the detergent formulations of reduced pentasodium triphosphate-content, which are made therewith, have an insufficient cleaning power.

Further detergent and cleaning compositions which contain 0.5 to 10 weight% of 1,3,5-tricarboxypentane-3-phosphonic acid have been disclosed in German Patent Specification "Offenlegungsschrift" No. 2 437 662. They have an improved cleaning power and compare favorably in this respect with detergent compositions containing the above oligocarboxy-alkane-phosphonic acid. Despite this, 1,3,5-tricarboxy-pentane-3-phosphonic acid is not ideally suitable for use as a builder. The reason for this resides in the fact that the acid is not readily available and that it is necessary for the detergent composition to contain relatively large proportions thereof in order to produce a satisfactory cleaning effect.

In German Patent Specification "Offenlegungsschrift" No. 2 327 861, is has been suggested that amino-substituted alkanepolyphosphonic acid, e.g. 1-aminoethane-1,1-diphosphonic acid or dimethylaminomethane-diphosphonic acid, should be used as builders.

These aminoalkane polyphosphonic acids are, however (2 weight%), difficultly soluble and dissolve reluctantly in water so that they are indeed not very suitable for use in detergent compositions. A property of great importance in the cleaning or washing operation is the dissolution behaviour of the builder which should be able to sequester the hardness inducing agents contained in water, immediately after the addition of water to the material which is to be washed or cleaned. In addition to this, it is necessary for aminomethane-diphosphonic acid, for example, to be used at a pH of 7. Only at that pH-value is the acid capable of absorbing about 330 mg Ca per 100 g substance and can be said to have the power for complexing lime which is typical of a good builder. Within the pH-range 9.5 to 10 which is normal for a cleaning or washing operation, the power for complexing lime of aminomethane-diphosphonic acid is reduced down to about 70 mg Ca per 100 g substance. In other words, the substance is not absolutely suitable for use as a builder. The same has been found to be true concerning the other amino-alkane phosphonic acids listed in German Patent Specification "Offenlegungsschrift" No. 2 327 861.

It is therefore an object of the present invention to provide builders which are free from the adverse effects described hereinabove, i.e. builders which are readily soluble, have an improved cleaning power enabling them to be used in lower concentrations, and can be prepared from commercially readily available raw materials.

In accordance with our present invention, we have unexpectedly found that cleaning and detergent compositions containing certain N-carboxy-methylamino-alkane diphosphonic acids in admixture with customary surfactants, builders and addends comply with the requirements set forth hereinabove.

The present invention provides more particularly detergent and cleaning compositions containing about 0.2 to 5 weight% of at least one compound of the general formula (I)

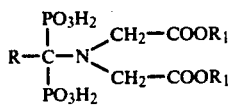

(I)

in which R stands for a hydrogen atom or a methyl group and $R_1$ stands for a hydrogen atom or an alkali metal or a $NH_4$-ion.

A preferred embodiment of the present invention provides for the detergent and cleaning compositions to contain from:

0.2 to 5 weight% of at least one compound of the above formula (I), 15 to 30 weight% of an alkali metal triphosphate, 6 to 25 weight% of at least one surfactant, and 30 to 78.8 weight% of at least one detergent auxiliary or addend.

Sodium tripolyphosphate is preferably used as the alkali metal triphosphate.

The surfactants, which are employed in accordance with the present invention, are selected from anionic, cationic, amphoteric, ampholytic and non-ionic substances.

The anionic surfactants comprise the water-soluble salts of higher fatty acids or resinic acid, such as sodium or potassium soaps of hardened or non-hardened coco palm-kernel oil or beet oil, or of tallow and suitable blends thereof. The anion-active substances used in the present invention also include higher alkyl-substituted, mono-nuclear, aromatic sulfonates, such as alkylbenzenesulfonates having from 9–14 carbon atoms in the alkyl radical, alkylnaphthalenesulfonates, alkyltoluenesulfonates, alkylxylenesulfonates or alkylphenolsulfonates as well as sulfated aliphatic alcohols or alcohol ethers, such as sodium or potassium lauryl or hexadecylsulfate, triethanolaminelaurylsulfate, sodium or potassium oleylsulfate, and sodium or potassium salts of laurylsulfate ethoxylated with about 2 to 6 mols of ethylene oxide. Further suitable anionic surfactants are secondary linear alkanesulfonates and α-olefinsulfonates having a chain length of 12 to 20 carbon atoms.

The non-ionic surfactants usable in accordance with the present invention are compounds which present an organic hydrophobic group and a hydrophilic radical. Exemplary representatives of these non-ionic surfactants are the condensation products of alkylphenols with ethylene oxide or of higher fatty alcohols with ethylene oxide, the condensation products of polypropyleneglycol with ethylene oxide or propylene oxide, and the condensation products of ethylene oxide with the reaction product of ethylenediamine and propylene oxide. The above compounds also include long-chain tertiary amine oxides.

The surfactant ingredients of the detergent and cleaning compositions of the present invention finally include ampholytic and amphoteric materials, for example derivatives of aliphatic, secondary or tertiary amines or quaternary ammonium compounds having from 8 to 18 carbon atoms and a hydrophilic group in the aliphatic radical, e.g. sodium-3-dodecylaminopropionate; sodium-3-dodecylaminopropanesulfonate; 3-(N,N-dimethyl-N-hexadecylamino)-propane-1-sulfonate or fatty acid aminoalkyl-N,N-dimethylacetobetain, the fatty acid containing between 8 and 18 carbon atoms and the alkyl radical containing 3 carbon atoms.

It is more particularly advantageous and practical for a detergent formulated in accordance with the present invention to contain a surfactant selected from dodeylbenzenesulfonate, hardened tallow soap and/or tallow fatty alcohol ethoxylated with 11 mols of ethylene oxide.

Further detergent aids or addends, which may be used in accordance with the present invention, include, for example: the alkali metal or ammonium salts of sulfuric acid, silicic acid, carbonic acid, boric acid, alkylene-, hydroxyalkylene- or aminoalkylenephosphonic acid, bleaching agents, stabilizers for peroxide compounds, and water-soluble organic complex formers.

These latter groups of compounds comprise more particularly sodium perborate monohydrate or tetrahydrate, alkali metal salts of peroxymono- or disulfuric acid, alkali metal salts of perpyrophosphoric acid, water-soluble percipitated magnesium silicate, and alkali metal salts of iminodiacetic acid, nitrilotriacetic acid, ethylenediaminetetracetic acid, methylenediphosphonic acid, hydroxyethanediphosphonic acid and nitrilotrismethylenephosphonic acid.

Still further ingredients of the detergent and cleaning compositions include substances improving the capacity of washing liquors for suspending or peptizing dirt, such as carboxymethylcellulose, polyvinyl alcohol, polyvinylpyrolidone, or foam regulators, such as mono- and dialkylphosphoric acid esters containing between 16 and 20 carbon atoms in the alkyl radical, as well as optical brighteners, disinfectants and/or proteolytic enzymes.

Very useful detergent aids or addends, which can be used in combination with the further ingredients of the detergent and cleaning compositions and contribute to improving the washing efficiency, are magnesium silicate, sodium silicate, sodium perborate tetrahydrate, sodium sulfate or carboxymethylcellulose.

The following Examples illustrate the invention which is not limited thereto.

EXAMPLE 1

Wash tests were made to determine the cleaning power of wash liquors which contained 1-[N-bis-(carboxymethyl)amino]ethane-1,1-diphosphonic acid (briefly termed ADP hereinafter) in admixture with sodium tripolyphosphate (briefly termed STPP hereinafter). The above wash tests were made with the use of wash liquors which contained the following ingredients in the following constant proportions, per liter of wash liquor:

0.35 g/l of dodecylbenzenesulfonate,
0.15 g/l of tallow fatty alcohol ethoxylated with 11 mols of ethylene oxide per mol of alcohol,
0.15 g/l of hardened tallow soap,
0.15 g/l of magnesium silicate,
0.15 g/l of sodium silicate,
1.25 g/l of sodium perborate tetrahydrate,
0.80 g/l of sodium sulfate, and
0.05 g/l of tylose but varying proportions of ADP and STPP.

Wash tests were made in a test series A with the use of wash liquors which contained varying (within the limits of 0.2 to 2.0 g/l) proportions of STPP, but a constant 0.01 g/l proportion of ADP.

The wash tests were made on standard cotton fabrics soiled with "Krefeld" dirt in a "Launder-O-meter" at a wash bath temperature of 95° C. Standard fabrics soiled with Krefeld dirt have been defined by Kurt Lindner in the book entitled: "Tenside, Textilhilfsmittel-Waschrohstoffe", Wissenschaftl. Verlagsgesellschaft Stuttgart (1964), volume II, page 1837.

The wash water had a hardness of 18° (German degrees of hardness) and a pH of 10, which was established by means of sodium hydroxide solution. The wash period was 30 minutes and the bath ratio, expressed by the ratio of material to be washed in kg to wash liquor in liters was 1:25, and the wash operation was carried out in the presence of 10 steel balls.

After the prescribed wash time, the standard cotton fabric was rinsed, once hot and once cold, with water of identical hardness, and its degree of whiteness was then determined at 530 mμ using a colorimeter RFC 3 (a product of Zeiss). Based on the test result, the cleaning power was calculated according to the following formula:

$$\%WK = \%WG_g - \%WG_b$$

in which

% WK = % cleaning power
% $WG_g$ = % whiteness of washed fabric
% $WG_b$ = % whiteness of unwashed fabric.

The cleaning effects produced in the above test series A are graphically plotted, curve A, in FIG. 1 of the accompanying drawings.

Further test series B, C, D and E were made in the manner described above for test series A, save that the wash liquor contained varying proportions of, or was left free from, ADP. In a test series F, 1,3,5-tricarboxypentane-3-phosphonic acid was substituted for ADP. More specifically, the wash liquor contained the following proportions of ADP in:

Test series B: 0.05 g/l of wash liquor
Test series C: 0.15 g/l of wash liquor
Test series D: 0.25 g/l of wash liquor
Test series E: ---
Test series F: 0.5 g/l of wash liquor.

Curves B, C, D, E and F in FIG. 1 represent the wash result produced in test series B, C, D, E and F, respectively.

As can be seen from the curves in FIG. 1, the detergent compositions containing ADP builder in combination with STPP builder have a significantly improved cleaning power. It can also be seen that ADP is approximately twice as effective as 1,3,5-tricarboxy-pentane-3-phosphonic acid, per gram of substance used.

EXAMPLE 2

Figure 2:
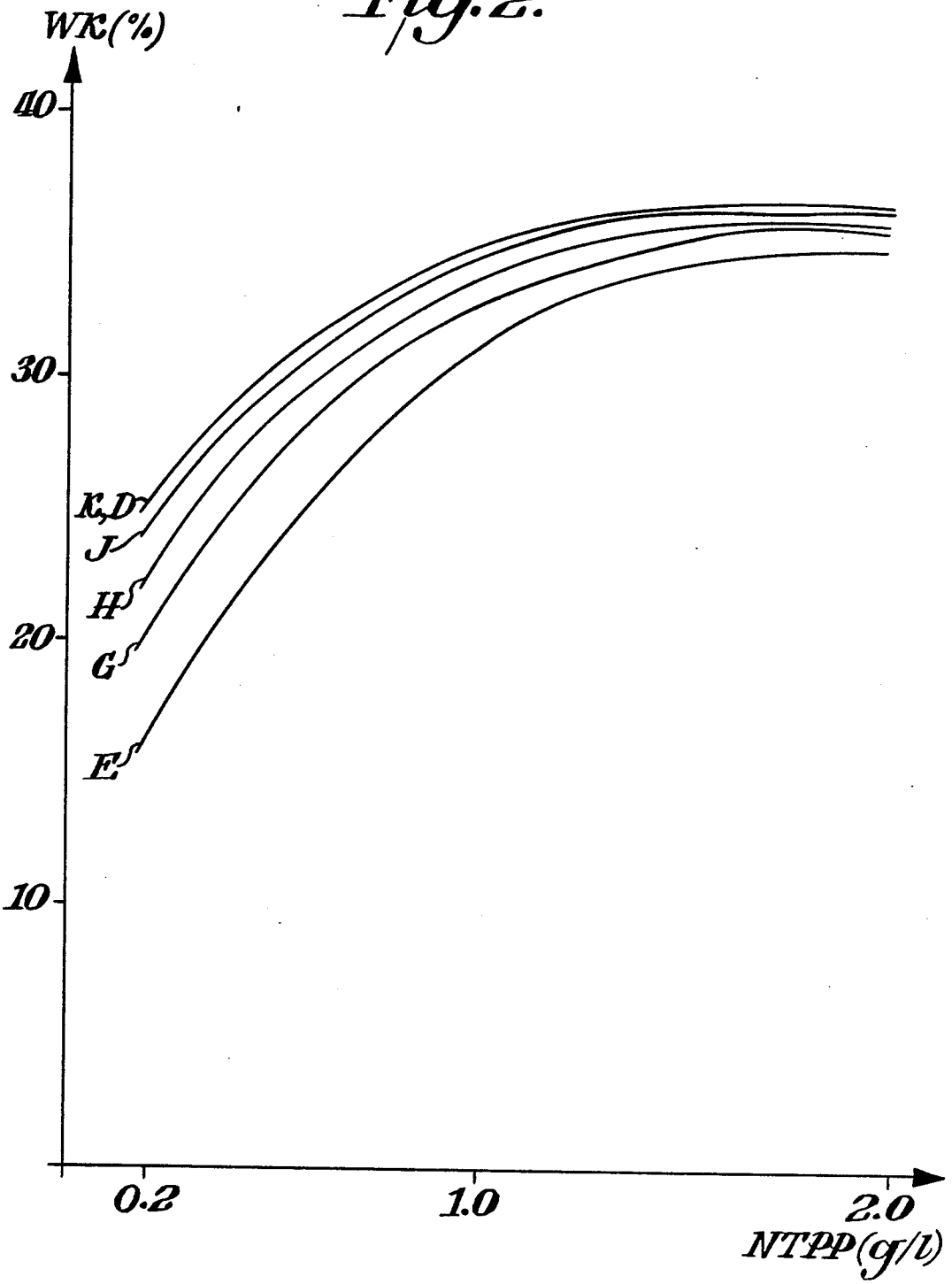

The procedure was as in Example 1, but [N-bis-(carboxymethyl)amino]-methane diphosphonic acid (briefly termed MDP) was substituted for ADP. The following proportions of MDP were used in:

Test series G: 0.05 g/l of wash liquor
Test series H: 0.15 g/l of wash liquor
Test series I: 0.25 g/l of wash liquor Curves G, H and I in FIG. 2 represent the wash results produced in test series G, H and I, respectively. Also indicated in FIG. 2 are the curves representing the wash results produced in test series D and E, for the purpose of comparison. As can be seen, the curves illustrate the good cleaning power of MDP.

EXAMPLE 3

The procedure was as in Example 1, but a blend of 0.15 g ADP and 0.10 MDP, per liter of wash liquor, was substituted for ADP. Wash tests were made on the wash liquor in a test series K. The wash results obtained are represented by curve K in FIG. 2.

We claim:

1. Cleaning and detergent composition containing from 0.2–5 weight % of at least one compound of the formula

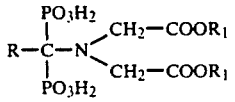

wherein R is hydrogen or methyl and $R_1$ is hydrogen or an alkali metal or $NH_4$ ion, 15–30 weight % of an alkali metal triphosphate,
6–25 weight % of at least one surfactant selected from the group consisting of dodecylbenzenesulfonate, tallow fatty alcohol ethoxylated with 11 mols of ethylene oxide and hardened tallow soap, and
30–78.8 weight % of sodium perborate tetrahydrate alone or together with at least one substance selected from the group consisting of magnesium silicate, sodium silicate, sodium sulfate and carboxymethylcellulose.

* * * * *